US005246653A

United States Patent [19]

Horres

[11] Patent Number: 5,246,653

[45] Date of Patent: Sep. 21, 1993

[54] APPARATUS FOR THE CONTINUOUS PRODUCTION OF MINERAL WOOL NONWOVENS

[75] Inventor: Johannes Horres, Ladenburg, Fed. Rep. of Germany

[73] Assignee: Grunzweig and Hartmann AG, Ludwigshafen, Fed. Rep. of Germany

[21] Appl. No.: 912,186

[22] Filed: Jul. 13, 1992

[30] Foreign Application Priority Data

Dec. 17, 1991 [DE] Fed. Rep. of Germany ..... 4141627

[51] Int. Cl.[5] ..... D04H 1/72

[52] U.S. Cl. ..... 264/113; 264/518; 264/121; 425/81.1; 425/83.1; 65/4.4; 65/9

[58] Field of Search ..... 264/518, 113, 121; 425/83.1, 81.1; 65/5, 9

[56] References Cited

U.S. PATENT DOCUMENTS 4,698,085 10/1987 Bengl et al. ..... 65/16
4,698,086 10/1987 Fachat et al. ..... 65/16
4,822,392 4/1989 Fachat et al. ..... 65/16
4,940,478 7/1990 Naber et al. ..... 65/27
4,961,695 10/1990 Hirscmann et al. ..... 425/72.2
5,065,478 11/1991 Furtak et al. ..... 19/296
5,093,069 3/1992 Mellem et al. ..... 264/510

*Primary Examiner*—Mary Lynn Theisen
*Attorney, Agent, or Firm*—Oblon, Spivak, McClelland, Maier & Neustadt

[57] ABSTRACT

An apparatus and a process for the continuous production of mineral wool nonwovens in the nonwoven formation process on the drums of the accumulating conveyors arranged at the lower end of a chute. Several fiberization units (1, 2, 3, 4) communicate with a chute (9) for the formation of a nonwoven (14). The fibres are deposited under the influence of suction pressure onto the curved surface of the accumulating conveyor (10, 11). At least one of the drum-shaped accumulating conveyors (10) is designed to swivel around a pivot (23) essentially arranged perpendicular to the flow direction (22) of the mineral wool such and to the extent that a discharge gap (21) can be adjusted to a width corresponding to the thickness of the nonwoven (14) to be formed.

10 Claims, 3 Drawing Sheets

APPARATUS FOR THE CONTINUOUS PRODUCTION OF MINERAL WOOL NONWOVENS

Figure 1:
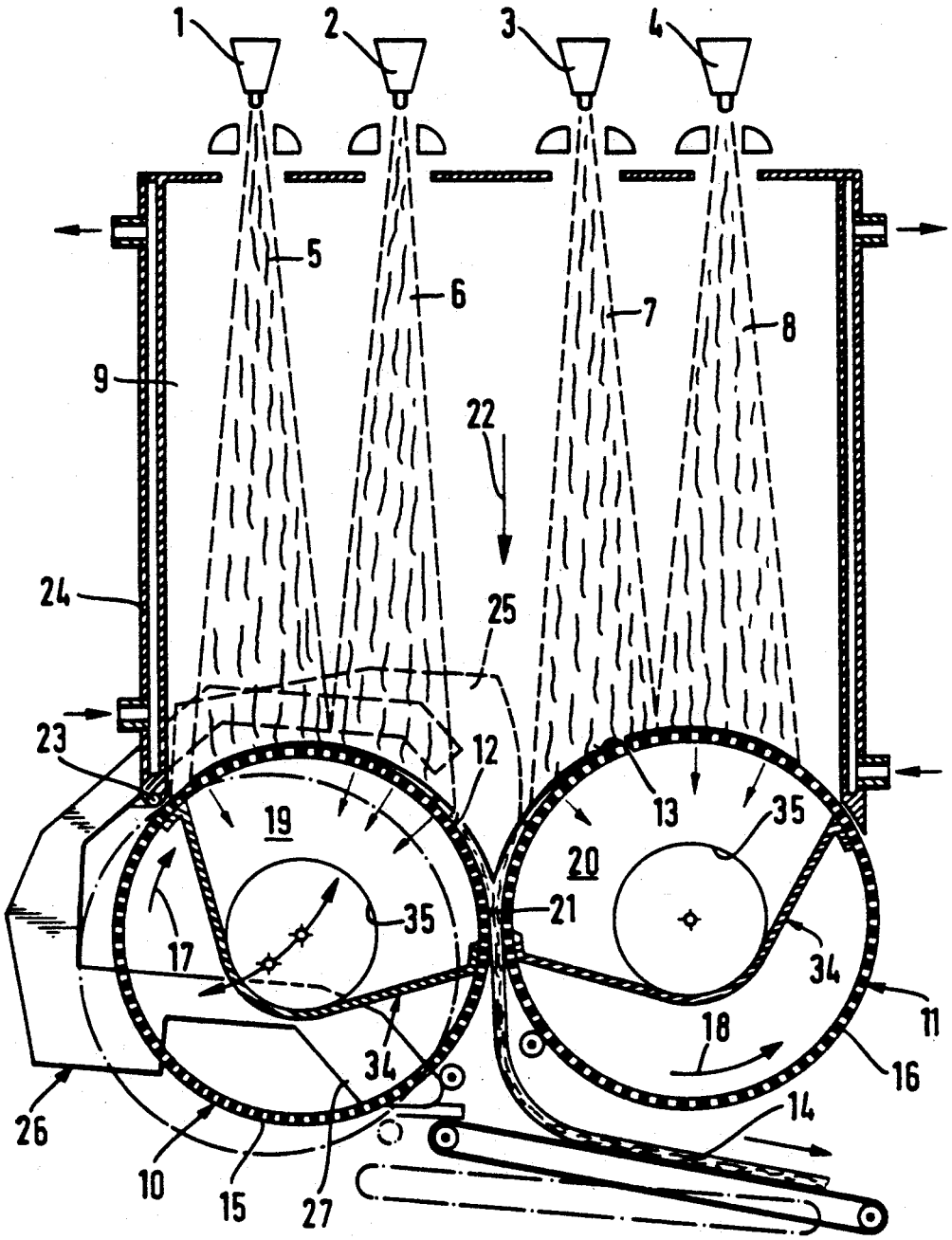

The invention relates to an apparatus for the continuous production of mineral wool nonwovens in accordance with the preamble of claim 1, and a process for the production of a multi-layered felt web in accordance with the preamble of claim 7.

A corresponding apparatus is known, for example, from German patent specification DE-PS 38 21 399, which provides for fiberisation units operating in accordance with the blast drawing process, said fiberisation units supplying a free jet bundle comprising a fibre/gas-/air/binder mixture. This free jet bundle is introduced into a box-shaped chute to separate the fibres, said chute featuring at its bottom an accumulating conveyor operating as a type of filter, said accumulating conveyor being designed in the form of two adjacent drums. A part of the surfaces of the drums serving to receive the deposited fibres is subjected to the effect of a suction pressure which is generated by an extraction device arranged within the drums. As a result of the effect of the suction pressure, the mineral wool introduced into the chute is deposited onto the counter-running drum-shaped accumulating conveyors, thus forming a nonwoven, and then discharged downward between these drum-shaped accumulating conveyors. In this known apparatus, the two adjacent drums form the lower boundary of the chute and must therefore be sealed at the outsides with sufficient tightness against the walls of the chute. The seal is effected at axially parallel lines of contact between the drums and the chute walls.

Between the drums is a fixed, pre-set gap which, in the known case, exceeds the largest envisaged nonwoven thickness. This large gap is closed by a sealing roller to leave a gap width which corresponds to the thickness of the actually produced nonwoven web in a certain ratio. In order to be able to produce different nonwoven thicknesses, the sealing roller is therefore swivellable around the axis of one of the drums and mounted at the circumference of this drum, and lies, depending on the angle of swivel, at a varying distance from the surface of the opposing drum.

For reasons of cost and in order to avoid the associated design and equipment outlay, the sealing roller itself has no extraction means.

It is also not involved in the actual nonwoven forming process, but rather limits the discharge gap between the drums. As a result, a zone is created in the mid region between the two drums where there is no extraction, thus constituting a pressurised zone which can hinder nonwoven formation there; because this pressurised zone in the gap between the drums has the effect that, where the nonwoven thickness on the drum surface is already at its greatest, increased process air is present, whereas it is precisely there where, owing to the less favourable suction conditions, extraction cannot be performed efficiently. The result is that, owing to this pressurised zone in the gap, there are no defined extraction conditions present, causing the deposition conditions for the nonwoven to be non-uniform and, under certain circumstances, even hindering nonwoven formation. This applies particularly in the case of small nonwoven layers, where the nonwoven of the first drum is initially raised from this first drum and then, without any appreciable adhesion or guide forces has to be transported over the smooth-finish sealing roller.

The object of the invention is to create an apparatus with which improved nonwoven formation can be accomplished on the drums.

Owing to the fact that at least one of the accumulating conveyors is designed to be sufficiently swivellable around a pivot, arranged essentially perpendicular to the flow direction of the mineral wool, to allow adjustment of a discharge gap to a width corresponding to the thickness of the nonwoven to be formed, the extraction zones of the accumulating conveyors can be arranged in as close a vicinity to each other as is just permitted in each individual case by the nonwoven thickness. An extraction-free zone with a width exceeding the nonwoven thickness currently being produced is thus avoided so that the best possible extraction conditions are ensured. This results in improved and more stable nonwoven deposition, particularly in the discharge gap between the accumulating conveyors. Moreover, as a result a larger nonwoven deposition zone can be created within the same chute dimensions, with the advantages of reduced extraction energy consumption and more voluminous primary nonwovens.

It has also been found that, owing to the defined extraction conditions at the accumulating conveyors, these exert a corrective influence on any non-uniform distributions of fibre material which nevertheless may still be present. On the assumption that somewhere on a suction area, for certain reasons too little or less mineral wool has been deposited, this means, for example, that at this point there is less flow resistance present. Owing to the constant partial vacuum present above the stator, more process air is attracted to this point, so that, correspondingly, more wool material in turn is transported to such points with the process air. Thus, any non-uniform distributions of deposited fibre which may occur are automatically corrected by the effects of defined suction conditions.

If the pivot of the accumulating conveyor lies in the region of an axially parallel generating line at which the chute wall meets the circumference of the accumulating conveyor, then different swivel positions of the accumulating conveyor do not give rise to differing sealing conditions. The end face seal is provided by a sealing plate which is swivellable together with the accumulating conveyor around the same pivot.

A particularly simple equipment design of the apparatus according to the invention is achieved if the accumulating conveyor is constructed as a drum with a stator which is swivellable around the pivot, and a rotor which is rotationally mounted on guide rollers around the stator.

To clean the accumulating conveyor of remaining fibre residues, movably mounted cleaning brushes are preferably provided at the inside circumference of the accumulating conveyor. Moreover, adjustable cleaning brushes are located on the outside circumference, as are additional high-pressure cleaning nozzles D, which preferably remove any encrustations on the drum surface by acting from the outside toward the inside.

Finally, a process is disclosed, revealing how multi-layered felt webs can be produced to good advantage by arranging several apparatuses according to the invention side by side, whereby the layers in this case can be produced with differing qualities.

Figure 2:
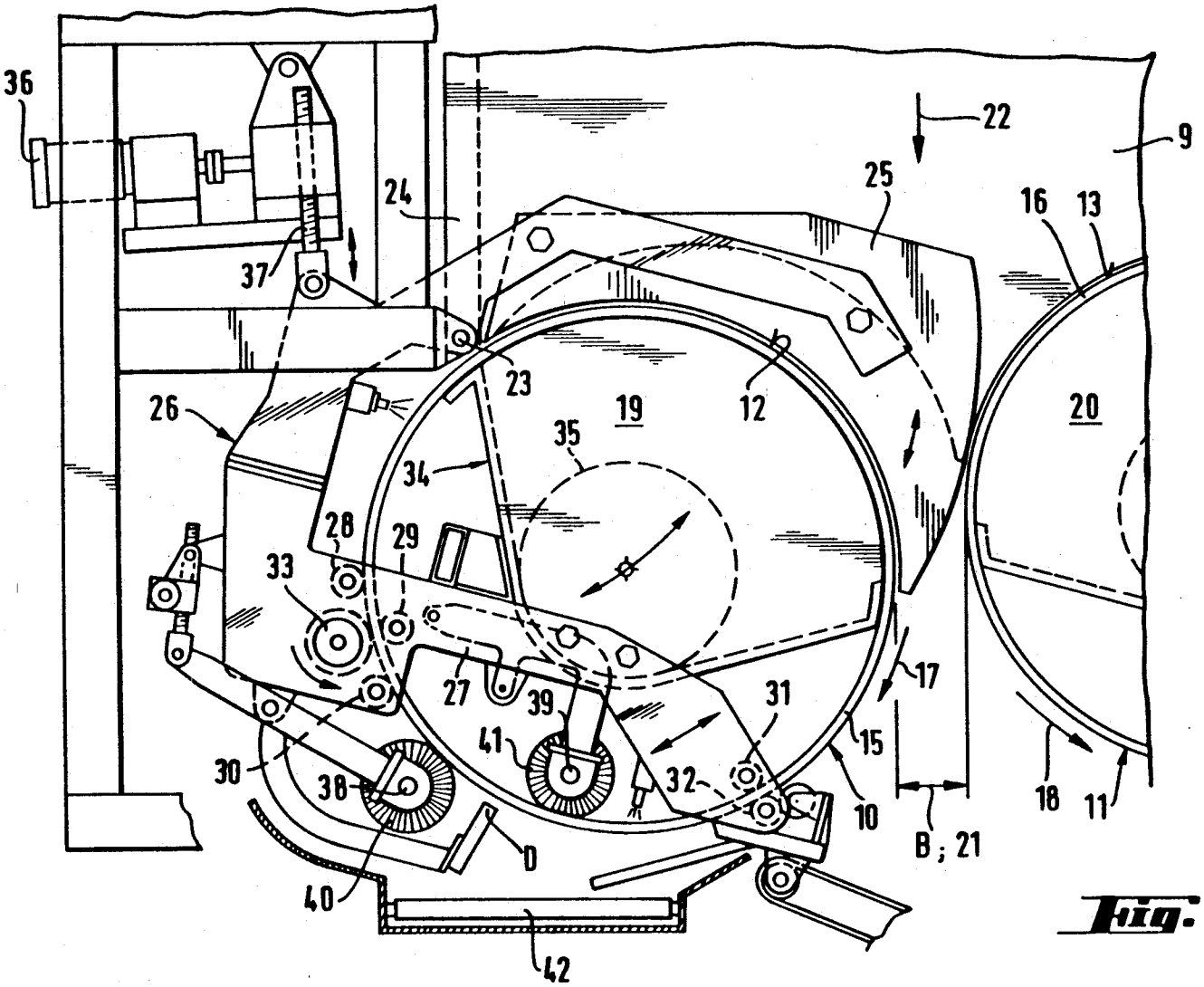
Figure 3:
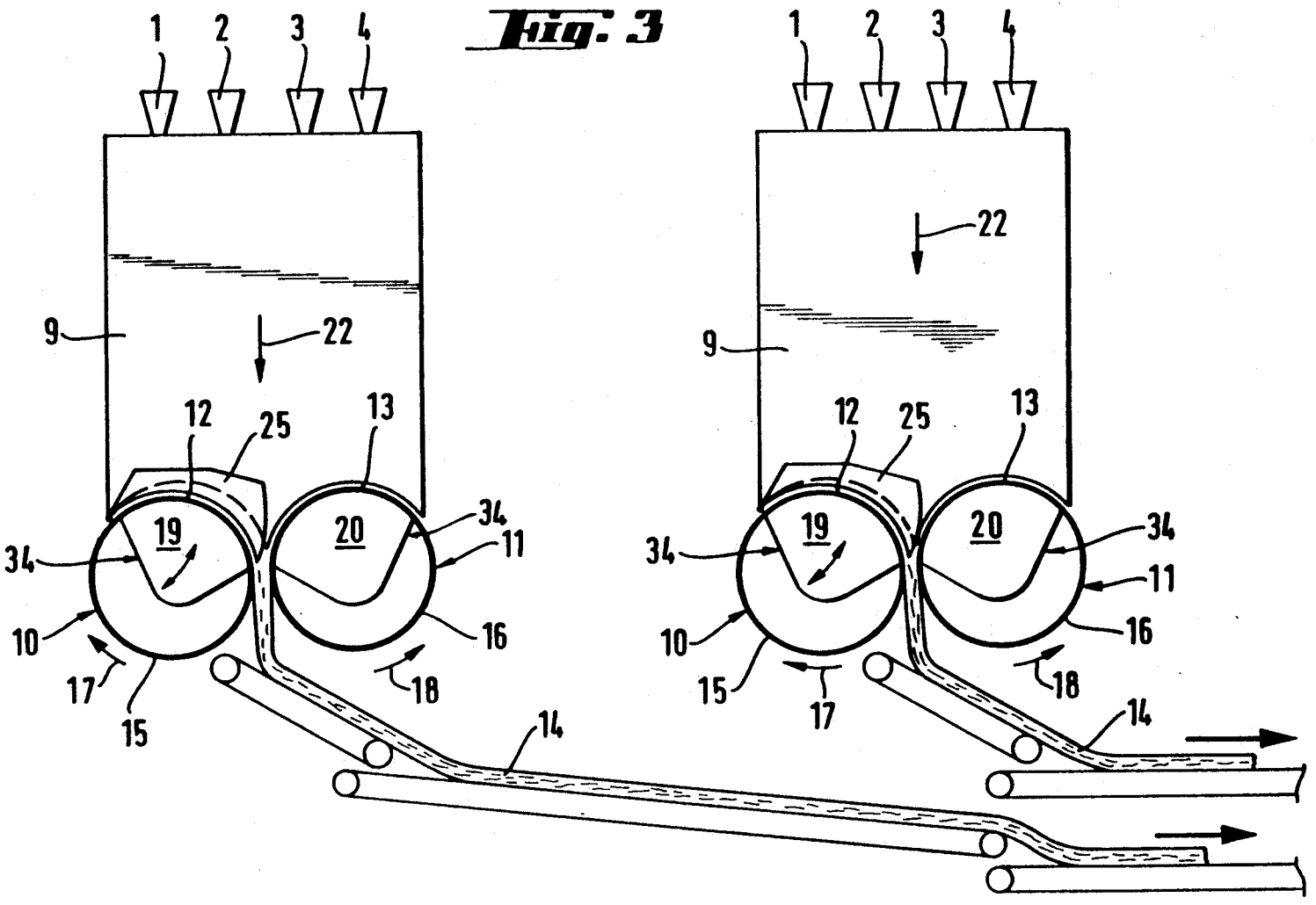

Further details, features and advantages of the invention are revealed in the following description of an embodiment by reference to the drawing, in which FIG. 1 shows a schematic section through a first embodiment of an apparatus according to the invention for the production of mineral wool nonwovens, with four fiberisation units and two accumulating conveyors designed in the form of drums and arranged at the lower end of a chute;

FIG. 2 shows a schematic simplification of a section through a swivellable accumulating conveyor in the form of a drum to illustrate further design details of the apparatus according to the invention, and FIG. 3 shows a schematic simplification of a section through a further embodiment of an apparatus according to the invention for the production of mineral wool nonwovens with two adjacently arranged production units.

As is apparent from FIG. 1, free jet bundles 5, 6, 7 and 8, which are roughly wedge-shaped in their geometry, are produced by, in this example, four fiberisation units 1, 2, 3 and 4 operating in accordance with the blast drawing process, said free jet bundles 5, 6, 7 and 8 consisting of a fibre/gas/air/binder mixture and being surrounded by a box-shaped chute 9. The lower termination of the chute is formed by two accumulating conveyors 10 and 11 in the form of drums, which follow a curved path, feature suction areas signified by 12 and 13 on which the fibres arriving from the fiberisation units 1 to 4 are deposited to form a wool nonwoven 14 from two joined primary nonwovens. The accumulating conveyors 10 and 11 each feature a rotating perforated (gas-permeable) rotor 15 and 16, each rotor being powered in the direction of the arrows 17 and 18, the conveying direction, by a motor arrangement and gear wheel 33 (FIG. 2) (drive arrangement not depicted in any further detail in FIG. 1). Furthermore, arranged inside the accumulating conveyors 10 and 11 is an extraction device, not depicted in any further detail, the suction pressure generated by which is active only in suction chambers 19 and 20 located below the curved suction areas 12 and 13. Between the two accumulating conveyors 10 and 11 there is a so-called discharge gap 21 which defines these and of which the width corresponds essentially to the thickness of the nonwoven to be produced, or is to be adapted to this thickness in accordance with a certain ratio.

According to the invention, the accumulating conveyor 10 is designed so that it can be swivelled around a pivot 23 which essentially is perpendicular to the flow direction 22 of the free jet bundles 5 to 8, and sufficiently far downward in accordance with FIG. 1 so that the width B of the discharge gap 21 can be adjusted in accordance with the thickness of the nonwoven 14 to be formed. The pivot 23 in this case lies in the area of that axially parallel generating line of the accumulating conveyor 10 at which the chute wall 24 meets the circumference of the accumulating conveyor 10.

A so-called sealing plate 25 in the form of a blade is provided for sealing each end face of the accumulating conveyor 10, which sealing plate 25 is swivellable together with the accumulating conveyor 10 around the same pivot 23. The sealing plate 25 thus swivels together with the accumulating conveyor 10 in FIG. 1 downward, so that the gap which would be left if there were no sealing plate when the accumulating conveyor is swivelled downward, is sealed by the sealing plate 25. The maximum width of the sealing plate 25 is predetermined in this case in accordance with the maximum possible swivel angle of the accumulating conveyor 10.

Further details of an embodiment according to the invention of an apparatus with a swivellable accumulating conveyor 10 are depicted in FIG. 2. A tilting mechanism with a swivel arm 26 is provided, which swivel arm 26 is rotationally mounted at the pivot 23 and supports a bracket 27 on which guide rollers 28, 29, 30 and 31, 32 are mounted on rotational shafts. The guide rollers 28 to 32 provide rolling guidance of the gas-permeable rotor 15 around the circumference of the drum-shaped accumulating conveyor 10. Firmly secured to the swivel arm 26 in three dimensions is a stator 34, to the exit side of which is connected a suction line 35 which, in turn, is connected to an extraction device (not depicted in any further detail).

The motive power for the tilting mechanism is provided by an electric motor 36 which is connected to the swivel arm 26 via actuators 37 for swivelling the accumulating conveyor 10, and via transverse profiles and rotational bearings. Also provided for driving the rotor 15 is a drive element 33 (gear wheel) which is rotationally mounted at the outside circumference of the rotor 15, and at a fixed distance from this, and which drives said rotor via a gear rim.

To clean the surface of the accumulating conveyor 10 of remaining wool residues or similar residues, a cleaning brush 41 is provided at the inside circumference of the accumulating conveyor 10, said cleaning brush 41 being rotationally mounted on a shaft signified by 39, the brushed-away wool waste falling onto, and removed by, a conveyor belt signified by 42. Moreover, rotationally mounted at the outside circumference of the accumulating conveyor 10 on the shaft signified by 38 is a further cleaning brush 40 for brushing the outside circumference of the circulating rotor 15 to remove wool residues.

Finally, shown schematically in FIG. 3, is a section of a production line with which felt web (not depicted in any further detail) comprising several layers of wool nonwovens 14 is continuously produced. By means of the swivelling mechanism of the one accumulating conveyor, it is further possible to produce, with ease, the individual layers for a composite felt web, whereby such layers may exhibit different thicknesses or bulk densities, i.e. a composite felt web with layers of differing qualities.

Overall, it is possible, through the invented design of the accumulating conveyors, to replace individual drums in the event of wear or damage easily and to good advantage, without the need to remove the entire accumulating conveyor unit from the actual chute and then dismantle it. This advantageous modular principle firstly reduces maintenance and repair time, and secondly simplifies the storage of spare parts.

I claim:

1. An apparatus for the continuous production of mineral wool nonwovens, in which a plurality of fiberisation units are provided for formation of the nonwoven in a chute, and the fibres can be deposited under the influence of a suction pressure on at least two accumulating conveyors with at least partially curved, gas-permeable surfaces of an accumulating conveyor, wherein at least one of the accumulating conveyors is swivellable around a pivot which is arranged substantially perpendicular to the flow direction of the mineral wool, whereby a discharge gap between said conveyors can be adjusted to a width in accordance with the thickness of the nonwoven comprising two primary nonwovens.

2. An apparatus as claimed in claim 1, wherein the pivot of the swivellable accumulating conveyor lies in the area of the axially parallel generating line at which the chute wall meets the circumference of the accumulating conveyor.

3. An apparatus as claimed in claim 1 or 2, wherein a sealing plate is provided for end-face sealing of the swivellable accumulating conveyor, said sealing plate being swivellable together with the swivellable accumulating conveyor around the same pivot.

4. An apparatus as claimed in one of the preceding claims 1 or 2, wherein at least one of said accumulating conveyors comprises a drum with a stator which is swivellable around the pivot, said drum being drivable by a drive element around the stator and guided by guide rollers.

5. An apparatus as claimed in one of the preceding claims 1 or 2, wherein at least one movably mounted cleaning brush is provided at the circumference of at least one of said accumulating conveyors for cleaning the surface of the accumulating conveyor of remaining wool residues.

6. An apparatus as claimed in at least one of the preceding claims 1 or 2, wherein at least one high-pressure cleaning device (D) which is traversable parallel to the drum axis, is provided for rapid removal of any obstinate encrustations.

7. A process for the continuous production of a felt web comprising several individual mineral wool nonwovens, said individual nonwovens being formed by an apparatus including at least two accumulating conveyors having partially curved gas permeable surfaces, at least one of said conveyors being swivellable about a pivot arranged substantially perpendicular to the flow direction of the mineral wool so that a discharge gap between the conveyors can be adjusted, wherein the individual nonwovens arriving from several apparatuses coverage at a travelling production conveyor where they are combined into a multi-layered felt web.

8. A process as claimed in claim 7, wherein the layers for the composite felt web are produced with different qualities.

9. A process as claimed in claim 8, wherein said qualities comprises thickness and bulk density.

10. An apparatus as claimed in claim 5, including at least one movably mounted cleaning brush provided inside at least one of said accumulating conveyors for cleaning the interior of said conveyor.

* * * * *